US012798827B2

(12) United States Patent
Van De Ven et al.

(10) Patent No.: US 12,798,827 B2
(45) Date of Patent: Nov. 17, 2026

(54) MODULAR CLIMATE CONTROL CONTAINER

(71) Applicant: Veba Beheer B.V., Eindhoven (NL)

(72) Inventors: Roland Petrus Bernardus Carolus Van De Ven, Eindhoven (NL); Elbertus Antonius Godefridus Van Den Acker, Eindhoven (NL)

(73) Assignee: VEBA BEHEER B. V., Eindhoven (NL)

( * ) Notice: Subject to any disclaimer, the term of this patent is extended or adjusted under 35 U.S.C. 154(b) by 0 days.

(21) Appl. No.: 19/116,420

(22) PCT Filed: Sep. 27, 2023

(86) PCT No.: PCT/NL2023/050504
§ 371 (c)(1),
(2) Date: Mar. 28, 2025

(87) PCT Pub. No.: WO2024/072217
PCT Pub. Date: Apr. 4, 2024

(65) Prior Publication Data

US 2026/0152319 A1 Jun. 4, 2026

(30) Foreign Application Priority Data

Sep. 28, 2022 (NL) ..... 2033173

(51) Int. Cl.
*B65D 6/24* (2006.01)
*B65D 6/34* (2006.01)
(Continued)

(52) U.S. Cl.
CPC ..... *B65D 11/1873* (2013.01); *B65D 11/26* (2013.01); *B65D 81/18* (2013.01); *B65D 81/3816* (2013.01)

(58) Field of Classification Search
CPC ..... B65D 11/1873; B65D 11/1866; B65D 81/18; B65D 90/08; B65D 7/12; B65D 7/24; B65D 21/083; B65D 81/38
See application file for complete search history.

(56) References Cited

U.S. PATENT DOCUMENTS 3,955,702 A * 5/1976 Lundy ..... F21S 8/088 220/4.28
4,558,797 A * 12/1985 Mitchell ..... B65D 90/08 52/282.4
(Continued)

FOREIGN PATENT DOCUMENTS

CN 106379624 A 2/2017
EP 0432053 A1 6/1991
(Continued)

OTHER PUBLICATIONS

International Search Report mailed Jan. 16, 2024, in corresponding International Application No. PCT/NL2023/050504, 5 pages.
(Continued)

*Primary Examiner* — Javier A Pagan
(74) *Attorney, Agent, or Firm* — Maier & Maier, PLLC

(57) ABSTRACT

A climate control container, including a plurality of side panels, a plurality of edge profiles, and a plurality of corner structures, where the components are configured for mutual co-action such that the container has a modular character.

20 Claims, 12 Drawing Sheets

(51) Int. Cl.
*B65D 81/18* (2006.01)
*B65D 81/38* (2006.01)

(56) References Cited

U.S. PATENT DOCUMENTS

| | | | | |
|---|---|---|---|---|
| 8,196,758 | B2 * | 6/2012 | Lee | A47B 47/03<br>403/182 |
| 9,079,707 | B2 * | 7/2015 | Winterberg | A01F 25/14 |
| 2002/0070215 | A1 * | 6/2002 | Walsh | B65D 19/18<br>220/6 |

FOREIGN PATENT DOCUMENTS

| | | | |
|---|---|---|---|
| ES | 2401022 | A2 | 4/2013 |
| GB | 1267809 | A | 3/1972 |

OTHER PUBLICATIONS

Written Opinion of the International Searching Authority mailed Jan. 16, 2024, in corresponding International Application No. PCT/NL2023/050504, 6 pages.

* cited by examiner

MODULAR CLIMATE CONTROL CONTAINER

FIELD

The invention relates to a climate control container, in particular a modular climate control container.

BACKGROUND

The global developments in supply chain predict that the cold chain will triple in size in the coming 5 years. Consumer trends, food safety and last mile delivery are driving this growth. There is a demand for smarter solutions when it comes to sustainability and traffic flow. Further development and more efficiency in both active and passive cooling solutions can contribute to further improvement of the global supply chain. Innovations for example focus on minimizing transport movements and maximizing capacity. An example of an essential part of the supply chain which can make a difference are cooling containers. Both passive and active cooling containers can be applied and require a different strategy on how to be optimally applied in the chain. A drawback of current supply chain processes is that parts of the chain are still rather inefficient and energy consuming and/or costly. Cooling container according to the prior art are for example rather bulky, which in fact results in the transport of air when a container is shipped in an empty state. Further, the volume of containers is typically not adaptable, which results in inefficiencies in the cooling process. There is a desire to further optimize the ease of use and flexibility of cooling containers.

SUMMARY

The invention provides thereto a climate control container, in particular a modular climate control container, comprising a plurality of side panels, in particular (thermally) insulating side panels, which are configured to define a container body, a plurality of edge profiles, wherein at least one edge profile, preferably multiple edge profiles, and more preferably each edge profile, defines at least part of a rib of the container body, wherein at least one edge profile, preferably multiple edge profiles, and more preferably each edge profile, comprises at least one first receiving space for receiving at least part of a first side panel, and at least one second receiving space for receiving at least part of a second side panel, and a plurality of corner structures, wherein at least (part of) one corner structure and at least one edge profile comprise complementary coupling elements for mutual coupling, and wherein each corner structure preferably comprises at least two complementary corner structure elements, wherein a first corner structure element is made of a first material and a second corner structure element is made of a second material. If applied, the at least the first corner structure elements and the edge profiles may comprise complementary coupling elements for mutual coupling.

The modular climate control container according to the present invention has several benefits over conventional climate control containers. The container according to the invention making use of a combination of side panels, edge profiles and corner structures which are configured for mutual co-action enables that a relatively simple but highly efficient modular configuration is obtained. The side panels, edge profiles and corner structures enable easy assembly and disassembly of the container. This results in that the user can easily assemble and disassemble the container. It further enables that any user is basically capable of assembling the container, without the need to be trained or to use any specialized equipment. The relatively easy assembly and disassembly is for example useful in case there are no products to be shipped within the container. Such is for example the case prior to actual use when the container is to be shipped from the manufacturer to the end user. Other moments in the supply chain can be the moment when goods are dropped at their destination and the container is to be returned to the sender. It could be understood that the shipping volume of disassembled components of the container take significantly less volume than an empty, fully assembled container. In a fully disassembled configuration there will be a kit of side panels, edge profiles and corner structures. The modularity of the container further enables that the user could easily adapt the volume of the container body based upon the volume of the goods which are to be transported. Volume adjustment of the volume of the container can further contribute to effective cooling, in particular when it comes to an active cooling process. The container according to the present invention may comprise four types of corner structures, such that, if applied, these are applied on the top and bottom corners that are opposite from one another. It may be the case that in the front of the container the corner structures at the top are similar but in a mirrored configuration, and similarly that the corner structures at the bottom position are similar but in a mirrored configuration. It may be the case that in the back of the container the corner structures at the top can be similar but in a mirrored configuration, and similarly that the corner structures at the bottom position can be similar but in a mirrored configuration. This further standardizes the components and therefore improves scalability and reduces manufacturing costs.

Preferably one first corner structure element and one second corner structure element define one corner structure.

A further benefit of the modular container according to the present invention is that the edge profiles and the corner structures enable that non profiled side panels can be applied. This is beneficial in view of labour and costs and in ease of production. Since at least one edge profile, preferably multiple edge profiles and more preferably each edge profile, comprises a first receiving space for receiving at least part of a first side panel and a second receiving space for receiving at least part of a second side panel enables that the panels can be easily received and retained within said receiving spaces. The edge profiles thereby provide a retaining and protective function for the side panels. There is in principle no need to provide a mechanical connection between the edge profiles and the side panels due to the smart use of receiving spaces. The use of complementary coupling element for the corner structure(s) and the edge profile(s) results in that mutual coupling between said components can be done in an efficient and relatively simple manner.

The modular climate control container according to the present invention is typically substantially rectangular and/or square shaped. Hence, it is conceivable that the container body is substantially rectangular and/or square shaped. The side panels may be configured to define a square and/or rectangular container body. The side panels are typically substantially flat. The edge profiles and corner structures typically have a 3D orientation. When it is referred to a side panel, within the context of this invention also a top panel or a bottom panel can be meant. Typically the container body according to the invention comprises 6 side panels.

The corner structure for use in a container according to the present invention preferably comprises a first corner structure element and a second corner structure element. wherein a first corner structure element is made of a first material and a second corner structure element is made of a second material. If applied, the at least the first corner structure elements and the edge profiles may comprise complementary coupling elements for mutual coupling. A corner structure that comprises a first corner structure element and a second corner structure element is beneficial for the stability and torsion stiffness of the corner structures and the container.

It is possible that at least one, preferably each, first corner structure element and/or second corner structure element extends in at least three directions. If applied, these three directions are preferably perpendicular to one another. The three directions may be directions that extend in a height, width and depth direction of the container. This is beneficial for a solid corner structure and to improve torsion stiffness.

In an embodiment, it is possible that at least one first corner structure element may comprise or define a corner structure element receiving space for receiving at least one, in particular one, second corner structure element. Such a corner structure element receiving space can be beneficial for the ease of assembly. In the corner structure element receiving space the first corner structure element may be in abutting contact with the second corner structure element. The second corner structure element may be fully enclosed within said corner structure element receiving space, if applied. The corner structure element receiving space may be defined by at least six, preferably eight, contact surfaces of the first corner structure element, where in an assembled configuration the first corner structure element is in abutting contact with the second corner structure element.

It is possible that the first corner structure element and second corner structure element optionally abut and/or engage each other in at least two, optionally three, contact surfaces. In an embodiment, at least one first corner structure element and at least one second corner structure element can be each provided with at least six, preferably eight, contact surfaces for abutting contact in an assembled configuration. Said contact surfaces are preferably substantially flat. If applied, these contact surfaces may also extend in at least two, preferably three directions. Preferably, these at least two, preferably three, directions can be substantially perpendicular to one another. The at least two, preferably three, directions may be directions that extend in a height, width and/or depth direction of the container. In an embodiment, the first corner structure and second corner structure element may comprise at least six, preferably eight, contact surfaces. Said contact surfaces preferably extend substantially parallel and/or perpendicular to the direction wherein at least one side panel extends. If applied, preferably each contact surface extends in at least one direction, chosen from the height, width and/or depth direction of the container. The contact surfaces are beneficial for an easy assembly, since they allow for only one way of assembling the first and second corner structure elements into one corner structure.

Optionally, the second corner structure element can be free from complementary coupling elements. The second corner structure element may be coupled to the first corner structure element and/or edge profiles by external coupling means, such as at least one screw. For example, the second corner structure element can be coupled to the first corner structure and/or the extrusion profiles by means of at least one mechanical connection element such as a screw.

Preferably, the first receiving space and the second receiving space of at least one edge profile are configured such that at least part of a first side panel and at least part of a second side panel engage each other and/or at least partially overlap each other. In this way, the insulating capacity of the side panels is fully used. The first side panel typically defines a first side wall whereas the second side panel defines a second side wall of the container body. An engaging and/or overlapping configuration of the first side panel and the second side panel will also result in a more stable configuration of the container body.

Typically, at least one edge profile encloses at least part of the first side panel and/or at least one edge profile engages and/or encloses at least part of the second side panel. In this way, the edge profile provides a protective and retaining function for the side panel(s). It is beneficial if at least one edge profile comprises a retaining member for retaining at least one side panel within a receiving space. It is for example conceivable that the edge profile comprises a first retaining member for retaining at least part of a first side panel within the first receiving space and/or that the edge profile comprises a second retaining member for retaining at least part of a second side panel within the second receiving space. At least one retaining member can for example be formed by a ridge, a hook, a rim and/or a cam. It is also conceivable that at least one retaining member is formed by a clamping member, for example a hook-shaped clamping member. The retaining member may be configured for retaining at least part of a side panel in a clamping manner. It is for example conceivable that the retaining member is substantially deformable and/or resilient. In this way the retaining function could be applied in a relatively simple manner. However, it is also conceivable that at least one retaining member is substantially rigid. It is for example conceivable that at least one retaining member extends inwardly with respect to the receiving space, for example the first or second receiving space. The corresponding side panel which is to be received in the receiving space can be provided with a recess or slit wherein the retaining member can be received.

In a preferred embodiment of the container, at least one corner structure comprises at least two legs, preferably at least three legs, wherein at least one leg and preferably each leg is configured to be coupled with an edge profile. The legs of the corner structure and the edge profile are preferably configured to be coupled via a form fitting engagement. It is for example conceivable that at least part of at least one leg, and preferably each leg, is received within an accommodation space defined by the edge profile. The edge profile may for example comprise at least one substantially hollow accommodation space. The use of a substantially hollow accommodation space defined by the edge profile has multiple benefits amongst which that a reduction of weight is obtained. It further enables easy co-action with for example the corner structure and optionally, the provision of a handle within the edge profile. At least part of the accommodation space preferably extends over the length of the edge profile. Typically, at least one and preferably each corner structure is connected with three edge profiles. This configuration provide a stable and rigid container design.

It is conceivable that the container comprises at least one cover element configured to cover at least part of at least one corner structure and/or at least part of at least one side panel. The cover element could provide a protective function for the corner structure and/or the side panel. It is for example conceivable that at least one cover element is connected to at least one corner structure and/or at least one edge profile. In a preferred embodiment, at least one corner structure and at least one cover element can be mutually connected by means of a snap connection. It is also conceivable that at least one corner structure and at least one cover element can be mutually connected by means of screw connection. In a further preferred embodiment, the outer surface of the edge profile(s) and the cover element(s) are substantially arranged in the same planes. The outer surface of the edge profile(s) could for example extend into the outer surface of the cover element. In this way, outwardly extending parts or elements due to misalignment can be prevented.

It is also possible that at least one corner structure comprises at least one support surface in particular configured for supporting at least part of at least one side panel, and in particular a corner of a side panel. It is for example possible that adjacent legs of the corner piece, if applied, substantially enclose the side panel.

The support surface can be positioned between adjacent legs, thereby providing a support and/or coverage of the side panel. At least part of the support surface can be substantially flat. It is also conceivable that at least part of the support surface is complementary in shape with respect to the side panel(s) which is/are to be supported.

The corner structures and the edge profiles comprise complementary coupling elements for mutual coupling. This positively contributes to the ease of use of the modular container. In a preferred embodiment, at least one corner structure comprises male coupling elements and at least one edge profile, and preferably multiple edge profiles, comprise female coupling elements, or vice versa. It is for example conceivable that at least one corner structure comprises a male coupling structure and that at least one edge profile comprises a complementary female coupling structure. Preferably, the distal ends, or legs, of a corner structure can be received within an accommodating space of an edge profile. Each coupling element may comprise multiple coupling members. It is for example conceivable that the male coupling element comprises multiple protruding coupling members and that the female coupling element define multiple inverse receiving spaces wherein said coupling members can be received.

In a preferred embodiment, at least one edge profile comprises at least one handle. It is for example conceivable that at least one handle is integrally formed within at least one edge profile. In a further preferred embodiment, the edge profile may comprises at least one substantially hollow accommodation space, wherein the handle is embedded within said accommodation space. The application of at least one handle enables that handling of the climate control container can be further optimized. The handle is preferably designed such that it can be manually gripped by a user. The integration of at least one handle within the edge profile results in that it can be prevented that external handles have to be applied. Therefore the design of the container can be more compact. This could reduce the overall volume but could also positively contribute to the ease of use and the durability of the container.

Not only the container as such may have a modular configuration, it is also conceivable that container parts have a modular arrangement. It is for example conceivable that at least one edge profile comprises multiple mutually coupled or connectable edge profile parts. In this manner, the length of the edge profile can be easily adapted to a desired dimension. The total dimensions of the container according to the present invention may vary. It is possible that the height of the container is in the range of 0.5-2.0 m and that the length of the container is in the range of 0.4-2.0 m and that the depth of the container is in the range of 0.8-4.10 m. It is also conceivable that for example an edge profile part comprising a handle is included in an assembly of adjacent edge profile parts. The coupling between separate edge profile part could be done via complementary coupling elements as described for the present invention.

It is imaginable that the width of at least one side panel is larger than the width of at least one edge profile. Hence, the width of the side panel may extend with respect to the length of the edge profile. The extending part of the side panel can be enclosed by at least part of a corner structure. In this manner, the corner structures and edge profiles can provide a frame around the side panels in an efficient manner.

The side panels according to the present invention are in particular (thermally) insulating side panels. At least one (thermally) insulating side panel could for example comprise a foam material, preferably a closed cell foam material. Is it for example also possible that at least one side panel is a laminated panel. At least one side panel, and preferably each side panel could for example be partially made of a foamed polymer. The foamed polymer may increases the insulating properties of the side panel(s) which is beneficial for the overall performance and efficiency of the climate control container. It is for example possible that at least one side panel comprises polystyrene, preferably extruded polystyrene. It is also conceivable that at least one side panel comprises polyurethane, preferably foamed polyurethane more preferably closed cell foam polyurethane. Preferably, the (thermally) insulating side panels are sandwich panel having a polymer foam core and polyester outer layers. The outer layers of the sandwich panel may for example comprise polyester. At least one side panel may comprise a vacuum insulated panel. It is also conceivable that at least one side panel, and preferably each side panel is made of a vacuum insulated panel. The dimension of the side panels can vary based upon the intended use. However, typically the thickness of a side panel will be in the range of 10 to 100 mm, preferably in the range of 25 to 75 mm. The insulating side panels typically have a thickness of substantially 40 mm, or 80 mm or 100 mm.

In a preferred embodiment, the climate control container comprises at least one door panel. It is for example conceivable that at least one side panel is formed by a door panel. It is also conceivable that at least one side panel comprises a door panel. It is also conceivable that the container comprises a door comprise at least two co-acting door parts. In a preferred embodiment, the container comprises at least one pivotable door panel. The door panel may thereto comprise at least one hinge. It is for example conceivable that at least one edge profile comprises at least one substantially hollow accommodation space and that the hinge(s) of the door panel are provided within said accommodation space. At least one hinge could for example comprise at least one hinge pin and at least one receiving space for receiving at least part of a door panel. It is for example possible that the hinge pin is substantially elongated. At least one hinge may for example extend over at least 75% of the length of the rib of the container body. In a further beneficial embodiment, the hinge extends substantially over the entire length of the edge profile. Such embodiment enables easy adjustment of the position of the door and positively contributes to the stability thereof. The hinge pin can for example be at least partially formed by a tube. The hinge could have a hinge leave, for example a single hinge leave, which defines a receiving space for receiving part of a door panel. The accommodation space may be configured to retain the hinge pin of the door panel. It is also conceivable that at least one edge profile comprises at least one hinge of the door panel. It is also conceivable that at least one corner structure is provided with at least one hinge of the door panel. Preferably the door panel is configured for making an angle of substantially 270 degrees. The door panel could further comprise at least one door handle. The door handle can be similar to any of the described embodiments of a handle for application in the present invention. It is conceivable that at least one hinge comprises an adjusting mechanism. Such adjusting mechanism is in particular configured for adjusting the outlining and/or positioning of the door within the container. At least part of the hinge could for example be made of a polymer and/or a metal. In a beneficial embodiment, It is conceivable that at least part of the hinge is made of the same material as a reinforcement element, or corner structure element, if applied.

At least one side panel preferably comprises an accommodating slot for accommodating at least one cooling unit. It is for example conceivable that the container is configuration for use in combination with an active cooling unit. The cooling unit may also form part of the container. Hence, the invention also relates to modular climate control container comprising at least one cooling unit. The cooling unit, if applied, is preferably configured for conditioning temperature within the container body in a range between −20 and +25 degrees Celsius. The cooling unit preferably comprises an inner part positioned inside the container body and an outer part positioned outside the container body. The cooling unit is preferably removably connected with the container. The accommodating slot can be provided in any suitable side panel, for example in a side panel opposite of a door panel, if applied. The cooling unit can be any conventional cooling unit which is suitable for use in combination with a climate control container.

In a preferred embodiment, at least one edge profile is an extruded edge profile. It is also conceivable that at least one corner structure, in particular at least one first corner structure element, is an extruded corner structure. Benefits of the use of an extrusion process are the relatively low manufacturing costs, the fact that continuous production can be applied and that typically profiles or structures which have good mechanical properties can be obtained. Another benefit is that the extruded edge profile(s) and/or extruded corner structure(s) will be relatively light without compromising on strength. This is beneficial as light weight material are preferred considered from transport point of view. It is for example conceivable that at least one edge profile and/or at least part of at least one corner structure, in particular at least one first corner structure element, is made of at least one polymer. At least one edge profile and/or at least one corner structure could for comprise any of the following nonlimiting materials: polyvinyl chloride (PVC), polyurethane (PU), nylon, polyethylene terephthalate (PET), poly(ethylene-vinyl acetate) (PEVA), ethylene-vinyl acetate (EVA) and/or acrylonitrile butadiene styrene (ABS) plastics. The polymer could also be a fiber reinforced polymer.

Another benefit of an extruded polymer first corner structure element is that it prevents that cold bridges occur within the container.

Preferably, at least one, and preferably each second corner structure element of one corner structure is manufactured from a metal, in particular aluminium, more in particular cast aluminium.

It is conceivable that at least one corner structure, in particular each corner structure, comprises a first corner structure manufactured from an extruded polymer and a second corner structure manufactured from a metal, in particular cast aluminium. In such an embodiment, each corner structure is preferably configured such that the first corner structure element is positioned in between the edge profile and the second corner structure element in the container according to the present invention. The second corner structure element may be connected to the edge profiles by a connection means, such as a screw. This combination is beneficial for an improved torsion stiffness by the second corner structure element while preventing cold bridges by the first corner structure element.

At least one corner structure may comprise at least one reinforcement rib and/or at least one reinforcement element. It is also conceivable that at least one edge profile comprises at least one reinforcement rib. The corner structure and/or the edge profile may also comprise a plurality of reinforcement ribs. A reinforcement rib can further contribute to obtaining good mechanical properties whilst not compromising on the overall weight, and typically even resulting in a reduced overall weight. A reinforcement element could positively contribute to the strength of the corner structure and/or its ability for force distribution. At least one reinforcement element could for example comprise at least one through hole for receiving at least part of a mechanical fixing element, such as a screw. It is for example conceivable that at least one corner structure comprises at least two corner structure elements, wherein a first corner structure element is made of first material and a second corner structure element is made of a second material. At least one corner structure element could function as a reinforcement element. It is imaginable that the first material comprises at least one polymer and/or that the second material comprises at least one metal. At least one polymer could for example comprise polyvinyl chloride (PVC), polyurethane (PU), nylon, polyethylene terephthalate (PET), poly(ethylene-vinyl acetate) (PEVA), ethylene-vinyl acetate (EVA) and/or acrylonitrile butadiene styrene (ABS) plastics. At least one metal could for example comprise iron, aluminium, dye cast aluminium, zinc, tin and/or combination thereof.

It is also conceivable that at least one corner structure comprises at least one access hole, and preferable multiple access holes. At least one access hole can be configured for receiving part of a mechanical fixing element, such as a screw. Despite that the modular container can be fully constructed without the need of any mechanical fixing means, it may be desired to apply additional, removable fixing elements in order to ensure the rigidity of the container. Mechanical fixing elements could for example be applied to (temporarily) fixate the mutual connection between the corner structures and the edge profiles. The access holes will provide guidance for a user where the fixing element are to be applied. It is also conceivable that both the edge profiles and corner structures comprises access holes, preferably wherein at least one access hole of the edge profiles is aligned with at least one access hole of the corner structure.

Possibly, the climate control container according to the invention can be provided with at least one set of wheels. The presence of wheels may further contribute to the ease of use of the container. Preferably the wheels are removably attached to the container, preferably via at least one edge profile and/or corner structure. The wheels can be removably attached to at least one corner structure, for example via an adapter plate.

Preferably, the container according to the present invention is free from the adhesives when assembled. To this end, it is possible that at least all corner structures, in particular all parts, of the container are demountable and remountable. This is beneficial for shipment purposes, but also for reducing the environmental impact and possibilities for recycling after use. The invention further relates to a kit of side panels, edge profiles and corner structures according to the present invention. The invention also relates to an edge profile according to the invention and a corner structure for use in a container according to the invention.

References to 'corner structure' in this document should also be understood as to refer to 'at least one first corner structure element and/or at least one second corner structure element'.

The invention will be further elucidated hereinafter on the basis of the non-limitative exemplary embodiments in the following clauses:

1. Modular climate control container, comprising:
   a plurality of side panels, in particular insulating side panels, which are configured to define a container body;
   a plurality of edge profiles, wherein at least one edge profile, and preferably each edge profile, defines at least part of a rib of the container body, wherein at least one edge profile, and preferably each edge profile, comprises:
      a first receiving space for receiving at least part of a first side panel;
      a second receiving space for receiving at least part of a second side panel; and
   a plurality of corner structures,
   wherein the corner structures and the edge profile comprise complementary coupling elements for mutual coupling.
2. Container according to clause 1, wherein the first receiving space and the second receiving space of the edge profile are configured such that at least part of a first side panel and at least part of a second side panel engage each other.
3. Container according to any of the previous clauses, wherein at least one edge profile comprises a retaining member for retaining at least one side panel within a receiving space.
4. Container according to any of the previous clauses, wherein at least one corner structure comprises three legs, wherein each leg is configured to be coupled with an edge profile.
5. Container according to any of the previous clauses, wherein at least one corner structure comprises at least one support surface in particular configured for supporting at least part of at least one side panel.
6. Container according to any of the previous clauses, wherein at least one corner structure comprises male coupling elements and wherein at least two edge profiles comprise female coupling elements, or vice versa.
7. Container according to any of the previous clauses, wherein at least one edge profile comprises at least one handle.
8. Container according to any of the previous clauses, wherein at least one edge profile comprises multiple mutually coupled edge profile parts.
9. Container according to any of the previous clauses, wherein the width of at least one side panel is larger than the width of at least one edge profile.
10. Container according to any of the previous clauses, wherein at least one, and preferably each side panel is at least partially made of a foamed polymer.
11. Container according to any of the previous clauses, wherein at least one side panel comprises an accommodating slot for accommodating at least one cooling unit.
12. Container according to any of the previous clauses, comprising at least one cooling unit.
13. Container according to any of the previous clauses, comprising at least one door panel.
14. Container according to any of the previous clauses, wherein at least one edge profile is an extruded edge profile.
15. Container according to any of the previous clauses, wherein at least one corner structure is an extruded corner structure.
16. Container according to any of the previous clauses, wherein at least one corner structure comprises at least one reinforcement rib and/or at least one reinforcement element.
17. Container according to any of the previous clauses, wherein at least one corner structure comprises at least two corner structure elements, wherein a first corner structure element is made of first material and a second corner structure element is made of a second material.
18. Container according to clause 17, wherein the first material comprises at least one polymer and wherein the second material comprises at least one metal.
19. Container according to any of the previous clauses, comprising at least one cover element configured to cover at least part of at least one corner structure and/or at least part of at least one side panel.

BRIEF DESCRIPTION OF THE DRAWINGS

The invention will be further elucidated by means of non-limiting exemplary embodiments illustrated in the following figures, in which.

DETAILED DESCRIPTION OF EMBODIMENTS

Within these figures, similar reference numbers correspond to similar or equivalent elements or features.

Figure 1:
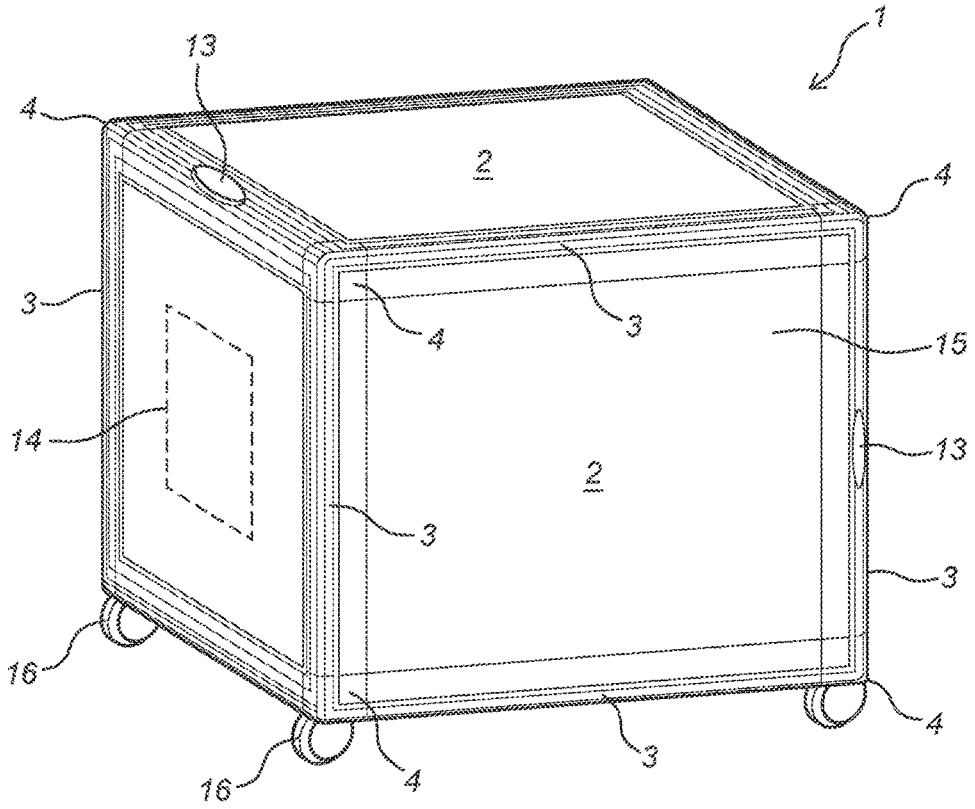
FIG. 1 shows a first possible embodiment of a modular climate control container according to the resent invention.

FIG. 1 shows a first possible embodiment of a schematic representation of a modular climate control container 1 according to the present invention. The climate control container 1 comprises a plurality of (insulating) side panels 2 which are configured to define a container body, a plurality of edge profiles 3 and a plurality of corner structures 4. It can be seen that each edge profile 3 defines part of a rib of the container body. The edge profiles 3 are configured for co-action with the side panels 2, wherein said side panels 2 are received within the edge profiles 3. Details hereof are shown in figures The side panels 2 are (thermally) insulating side panels 2, in particular sandwich panels 2 having a foam core and rigid outer layers. The corner structures 4 and the edge profiles 3 comprise complementary coupling elements for mutual coupling. In the shown embodiment, an edge profile 3 comprises a handle 13. Optionally, the container 1 could comprise an accommodating slot 14 for accommodating at least one cooling unit. The container 1 could additionally comprise a cooling unit (not shown) too which can be received within the accommodating slot 14. In the shown embodiment, one side panel 2 functions as a door panel 15. The door panel 15 as shown is a pivotable door panel 15. The door panel may thereto comprise at least one hinge. It is for example conceivable that at least one edge profile comprises at least one substantially hollow accommodation space and that the hinge(s) of the door panel are provided within said accommodation space. At least one hinge could for example comprise at least one hinge pin and at least one receiving space for receiving at least part of a door panel. It is for example possible that the hinge pin is substantially elongated. The hinge pin can for example be at least partially formed by a tube. The hinge could have a hinge leave, for example a single hinge leave, which defines a receiving space for receiving part of a door panel. The accommodation space may be configured to retain the hinge pin of the door panel. It is also conceivable that at least one edge profile comprises at least one hinge of the door panel. The door panel 15 comprises a door handle 13. It can be seen that the climate control container 1 has an efficient design. The corner structures 4 thereto comprise covers elements. The outer surface of the edge profiles 3 and the outer surface of the cover elements are substantially arranged in the same planes. The handles 13 are embedded within the edge profiles 3. This results in a compact design which is also attractive from aesthetic point of view. The outer surface of the edge profile(s) could for example extend into the outer surface of the cover element. In this way, outwardly extending parts or elements due to misalignment can be prevented. The container 1 could optionally be provided with a plurality of wheels 16.

Figure 2A:
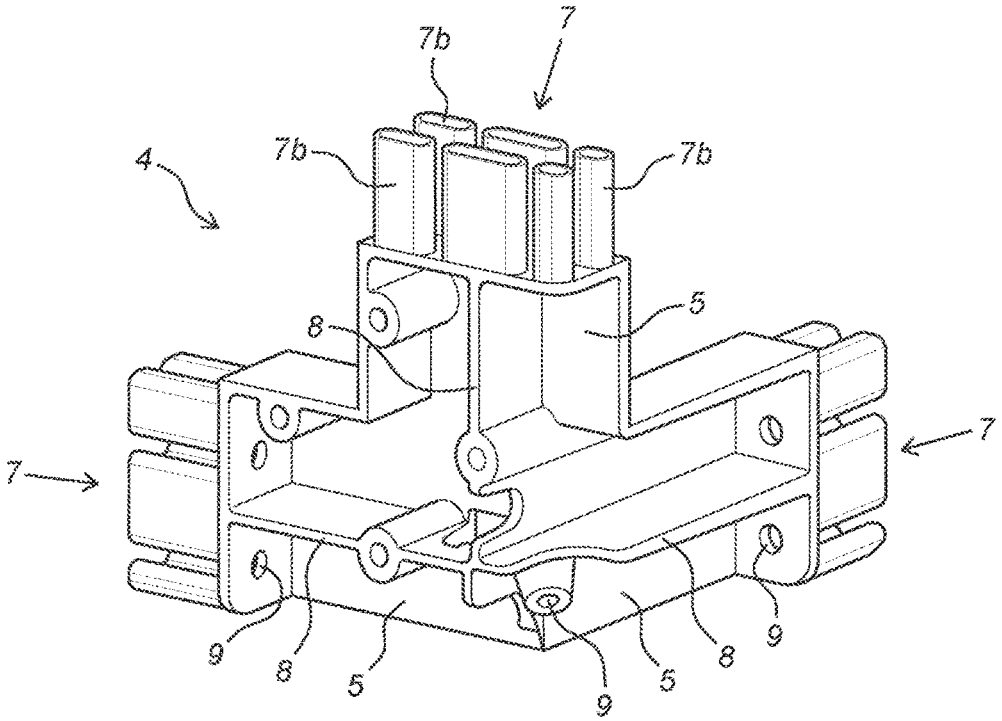
FIGS. 2*a* and 2*b* show a corner structure for use in a climate control container according to the present invention.
Figure 2B:
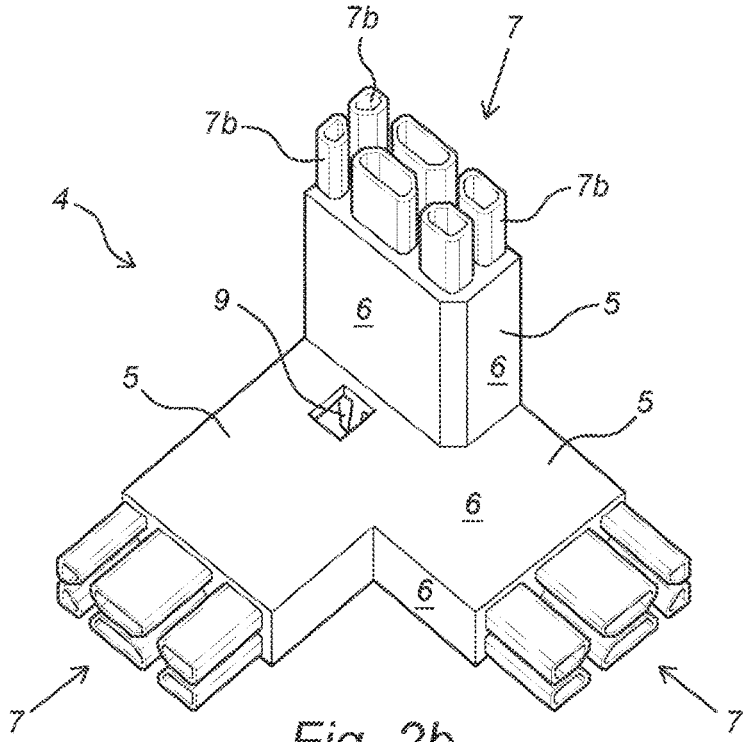

FIGS. 2*a* and 2*b* show a corner structure 4 configured for use in a climate control container according to the present invention. Both figures show a perspective view, where FIG. 2*a* shows an outer part of the corner structure 4 and FIG. 2*b* shows an inner part, or bottom view, of the corner structure 4. In the shown embodiment, the corner structure 4 comprises three legs 5, wherein each leg 5 is configured to be coupled with an edge profile. The corner structure 4 further comprises in the shown embodiment a support surface 6 for supporting at least part of a side panel. In the shown embodiment, the corner structure 4 comprises male coupling elements 7 which are configured for co-action with complementary female coupling elements of an edge profile, for example such as shown in FIG. 3. Each male coupling element 7 comprises a plurality of protruding coupling members 7*b*. In the shown embodiment, the protruding coupling members 7*b* are substantially hollow and have a cornered configuration. The outer part of the corner structure 4, as shown in FIG. 2*b*, comprises multiple reinforcement ribs 8. The corner structure 4 further comprises a plurality of access holes 9 configured for receiving mechanical fixing elements, such as but not limited to screws. The corner structure 4 as shown is configured for co-action with a cover element (not shown) which could be snapped onto the outer side of the corner structure 4. Alternatively, the cover element could be fixed onto the corner structure, for example by making use of a mechanical fixing element.

Figure 3A:
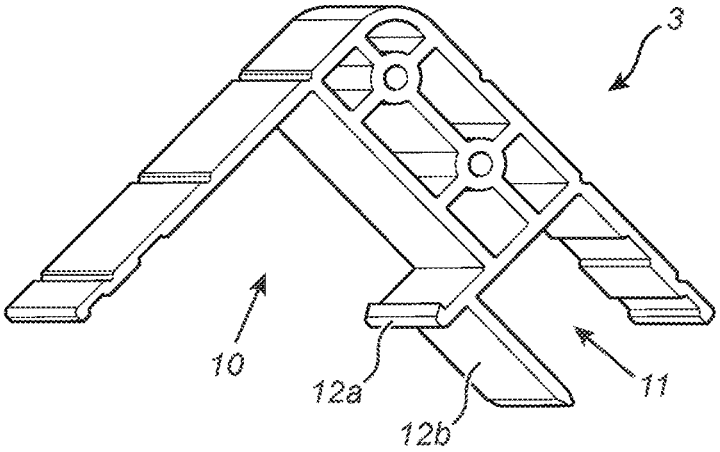
FIGS. 3*a* and 3*b* show an edge profile for use in a climate control container according to the present invention.
Figure 3B:
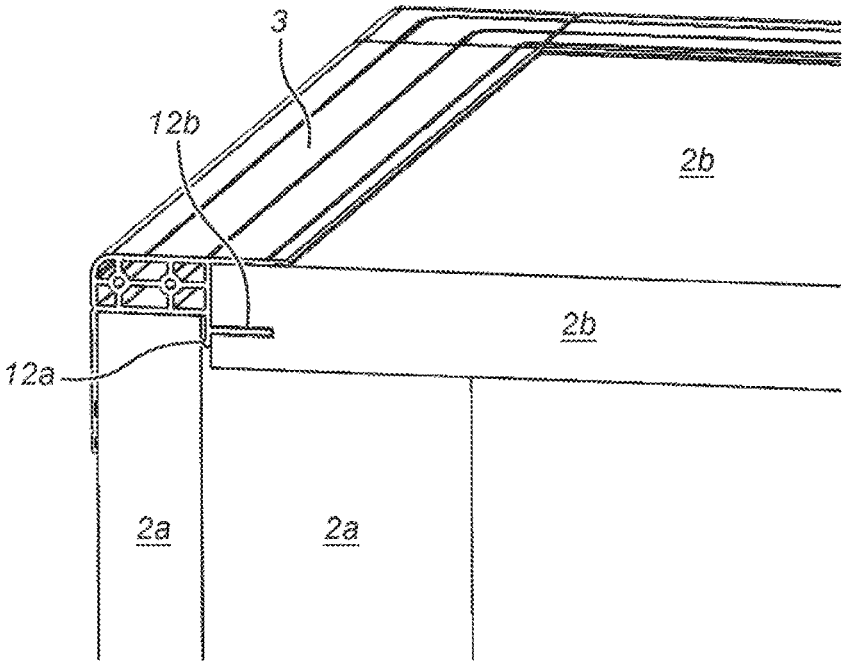

FIGS. 3*a* and 3*b* show a perspective view of part of an edge profile 3 for use in a climate control container according to the present invention. FIG. 3*a* shows the edge profile 3 as such, whereas FIG. 3*b* shows said edge profile 3 in combination with two side panels 2. The edge profile 3 is configured to define at least part of a rib of the container body. The edge profile 3 comprises a first receiving space 10 for receiving at least part of a first side panel 2*a* and a second receiving space 11 for receiving at least part of a second side panel 2*b*. The edge profile 3 comprises a retaining members 12*a*, 12*b* for retaining at least part of a side panels 2*a*, 2*b*. The first retaining member 12*a* is configured to clampingly engage part of the first side panel 2*a*. The second retaining member 12 is configured to protrude into the second side panel 2*b*, thereby providing a retaining function. The side panel 2*b* is provided with a slit in which the retaining member 12*b* is to be received. It can be seen in the figures that the first receiving space 10 and the second receiving space 11 are configured such that part of the first side panel 2*a* and part of the second side panel 2*b* engage each other and that said panels 2*a*, 2*b* partially overlap each other.

Figure 4:
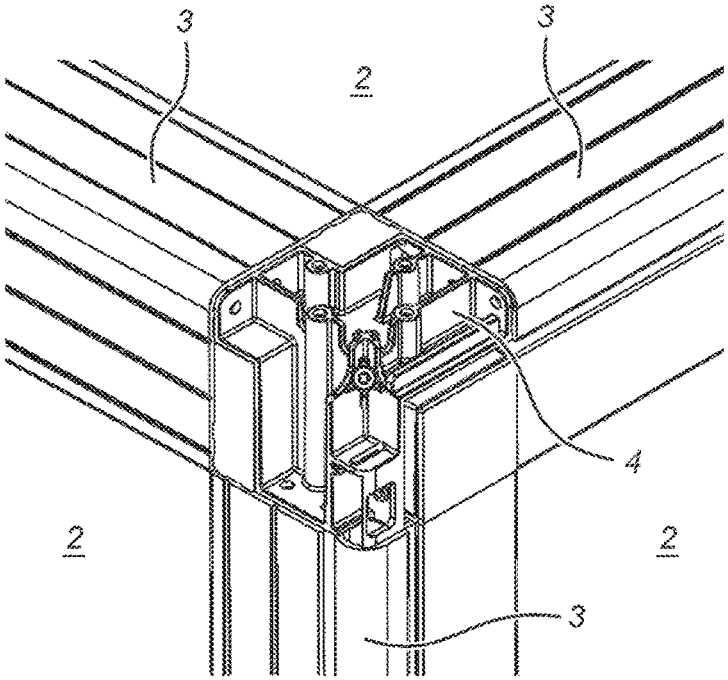
FIG. 4 shows a detail a container as shown in FIG. 1.

FIG. 4 shows a detail of a the container 1 as shown in the previous figures. The figures shown a corner structure 4 as shown in FIGS. 2*a* and 2*b* in combination with three edge profiles 3 and side panels 2 as shown in FIGS. 3*a* and 3*b*. The cover element as shown in FIG. 1 which is configured to cover the corner structure 4 is not shown. The legs of the corner structure 4 are received within the accommodation space defined by the edge profiles 3.

Figure 5A:
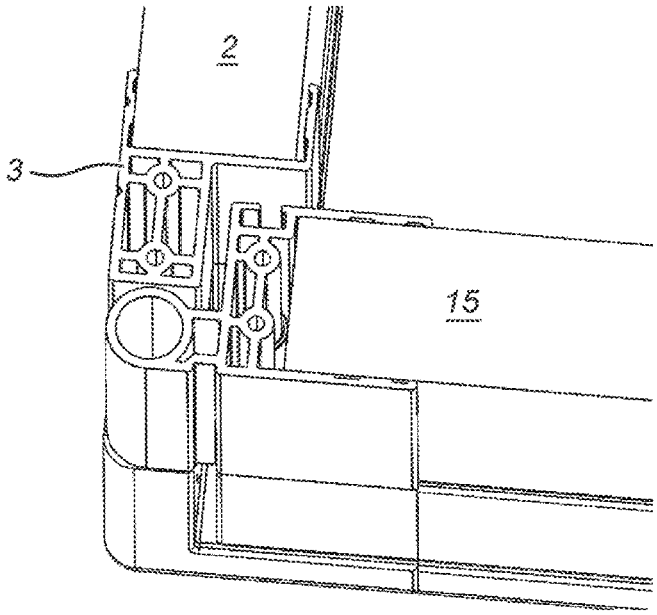
FIGS. 5*a*, 5*b* and 5*c* shows further details of a container as shown in FIG. 1.
Figure 5B:
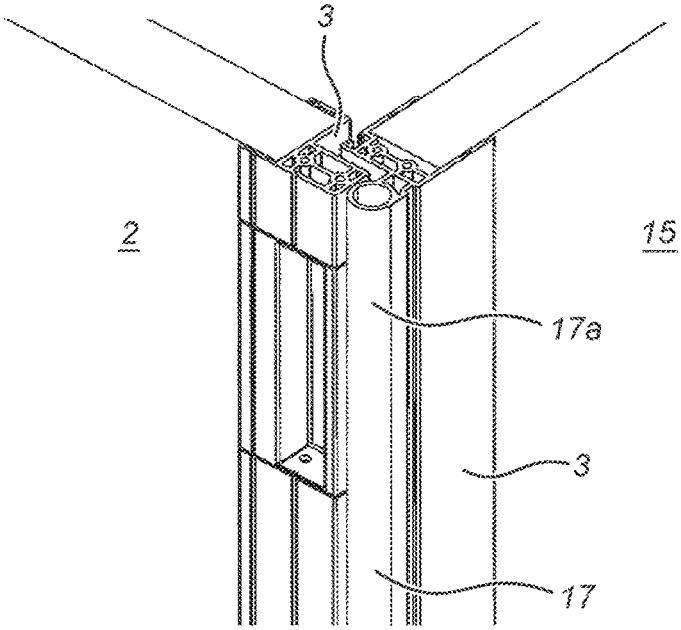
Figure 5C:
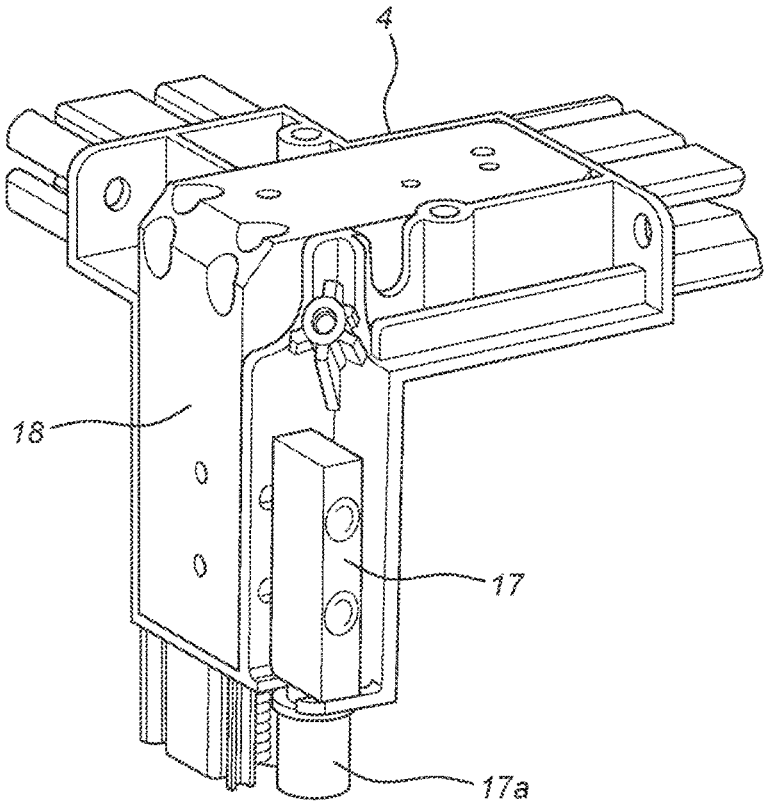

FIGS. 5*a*, 5*b* and 5*c* show a detailed view of part of a pivotable door 15 of the container 1 according to the present invention. Each figure shows a perspective view. FIG. 5*a* shows part of the bottom of container 1 and FIG. 5*b* shows a middle part. FIG. 5*c* show a corner structure 4 which comprises a reinforcement element 18. The door panel 15 is received in an edge profile 3 which is provided with a hinge 17. The hinge 17 comprises a hinge pin 17*a* and at least one receiving space equivalent to the receiving space of the edge profiles 3 according to the invention for receiving at least part of a door panel. The hinge pin 17*a* is substantially elongated. The hinge 17 is connected to part of the reinforcement element 18, in particular via an adjusting mechanism. The reinforcement part shown can be seen as a second corner structure element.

Figure 6A:
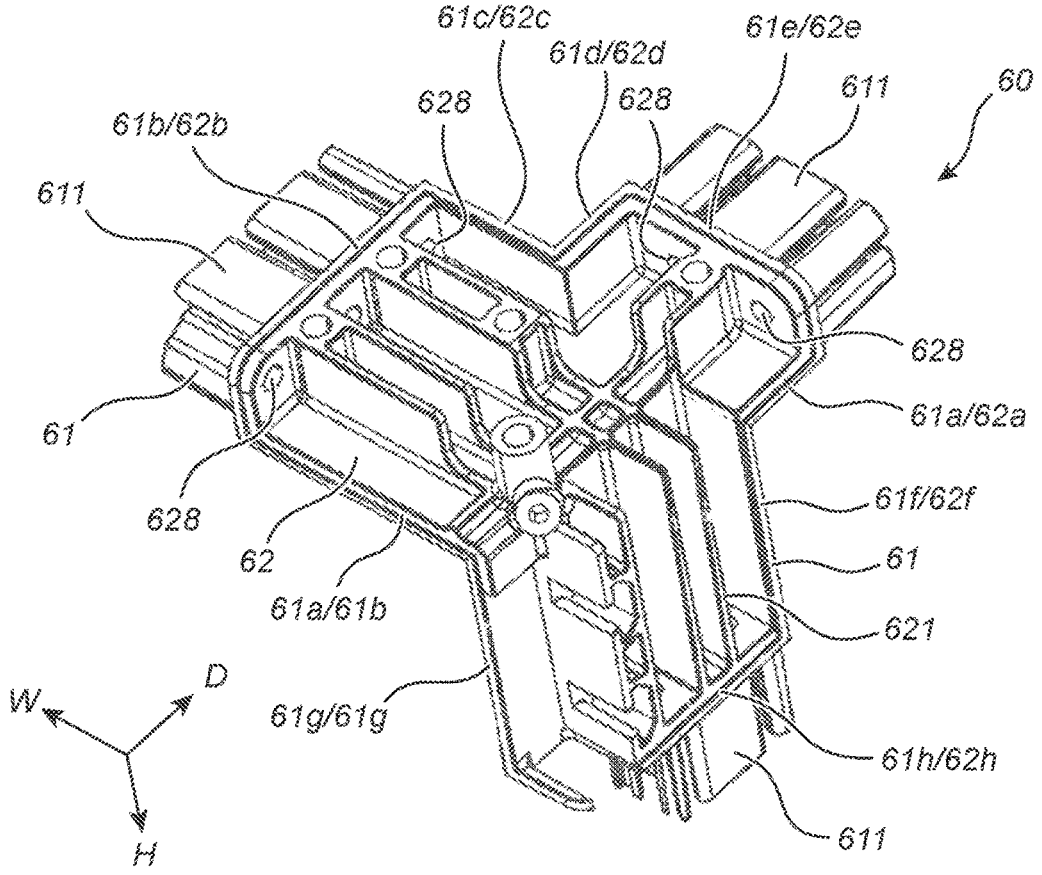
FIG. 6*a* shows a perspective view on an embodiment of a corner structure comprising a first corner structure element and a second corner structure element.
Figure 6B:
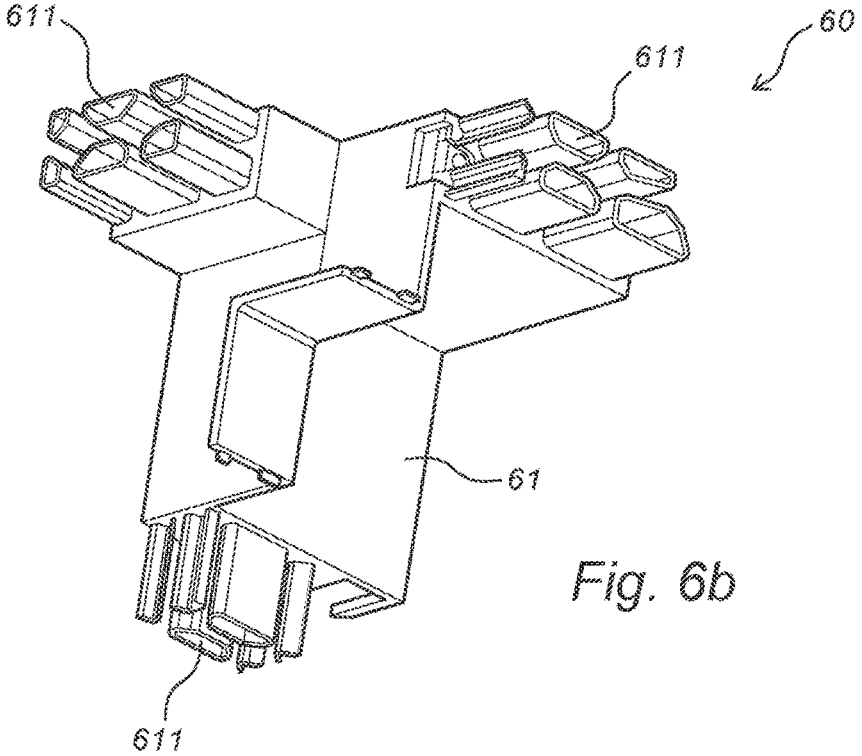
FIG. 6*b* shows a second perspective view on the embodiment of FIG. 6*a;*
Figure 6C:
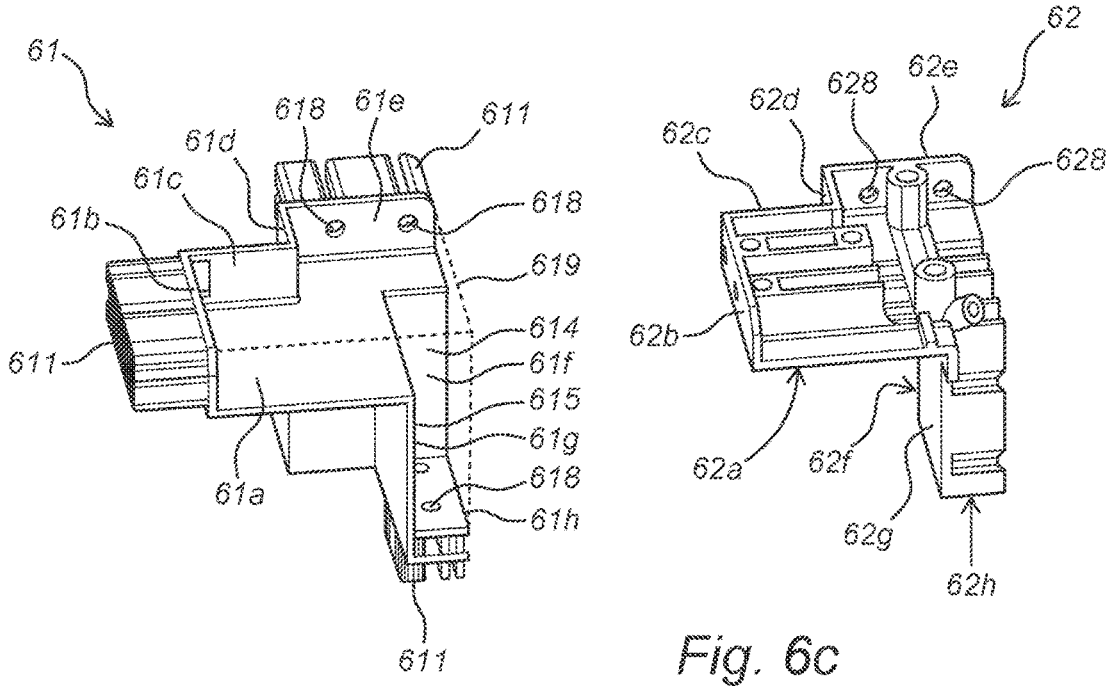
FIG. 6*c* shows an exploded view on the embodiment of FIG. 6*a;*
Figure 6D:
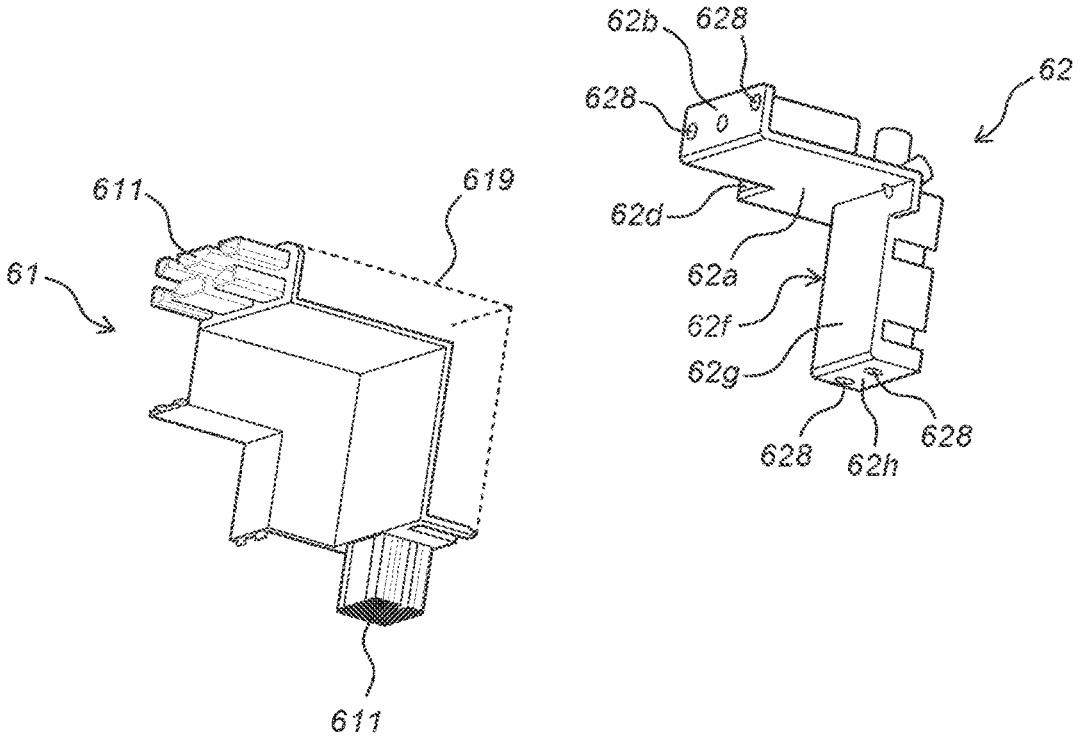
FIG. 6*d* shows a second exploded view on the embodiment of FIG. 6*a;*

FIG. 6*a* shows a perspective view on an embodiment of a corner structure comprising a first corner structure element and a second corner structure element; FIG. 6*b* shows a second perspective view on the embodiment of FIG. 6*a*; FIG. 6*c* shows an exploded view on the embodiment of FIG. 6*a*; FIG. 6*d* shows a second exploded view on the embodiment of FIG. 6*a*. The FIGS. 6*a*-6*d* show an embodiment of a corner structure element 60, comprising a first corner structure element 61 and a second corner structure element 62. These extend in three directions, width W, depth D and height H direction of the container. This corner structure element comprises a first corner structure element 61, manufactured from polymer. The first corner structure element 61 comprises coupling means in the form of legs 611 that are complementary with coupling means in the edge profiles (not shown). The corner structure 60 further comprises a second corner structure element 62, manufactured from aluminium. The second corner structure element 62 comprises reinforcement ribs 621. The second corner structure element 62 further comprise through holes 628 for connection with the first corner structure element 61 via the through holes 618 and the edge profiles (not shown).

The first corner structure element 61 comprises eight contact surfaces 61*a*, 61*b*, 61*c*, 61*d*, 61*e*, 61*f*, 61*g*, 61*h* that are complementary to the contact surfaces 62*a*, 62*b*, 62*c*, 62*d*, 62*e*, 62*f*, 62*g*, 62*h* of the second corner structure element 62. In assembly these are in abutting contact with one another. Contact surface 61*a* is in contact with contact surface 62*a*, contact surface 61*b* is in contact with 62*b*, 61*c* with 62*c*, 61*d* with 62*d*, 61*e* with 62*e*, 61*f* with 62*f*, 61*g* with 62*g* and 61*h* with 62*h*. The contact surfaces 61*a-f* and 62*a-f*, each extend in a width, depth or height direction of the container. The contact surfaces extend in three substantially perpendicular directions. The first corner structure element 61 comprises a corner structure element receiving space 619 for receiving the second corner structure element 62.

Figure 7:
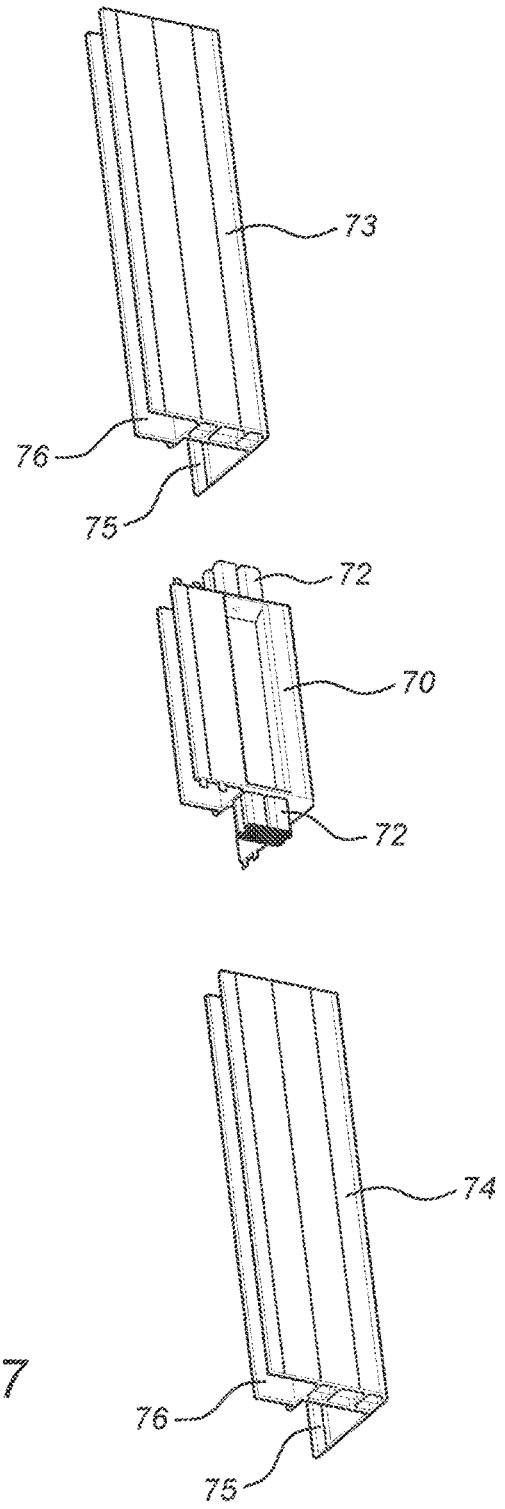
FIG. 7 shows an exploded view of a handle and two extruded edge profiles.

FIG. 7 shows an exploded view of a handle and two extruded edge profiles. The figure shows a door handle 70 comprising coupling means 71 on opposite sides 70*a*, 70*b*, that are complementary to the coupling means in the form of legs 72 within the extrusion profiles 73, 74. The extrusion profiles 73, 74 shown comprise first and second receiving spaces 75, 76 for receiving thermally insulating side panels (not shown).

Figure 8:
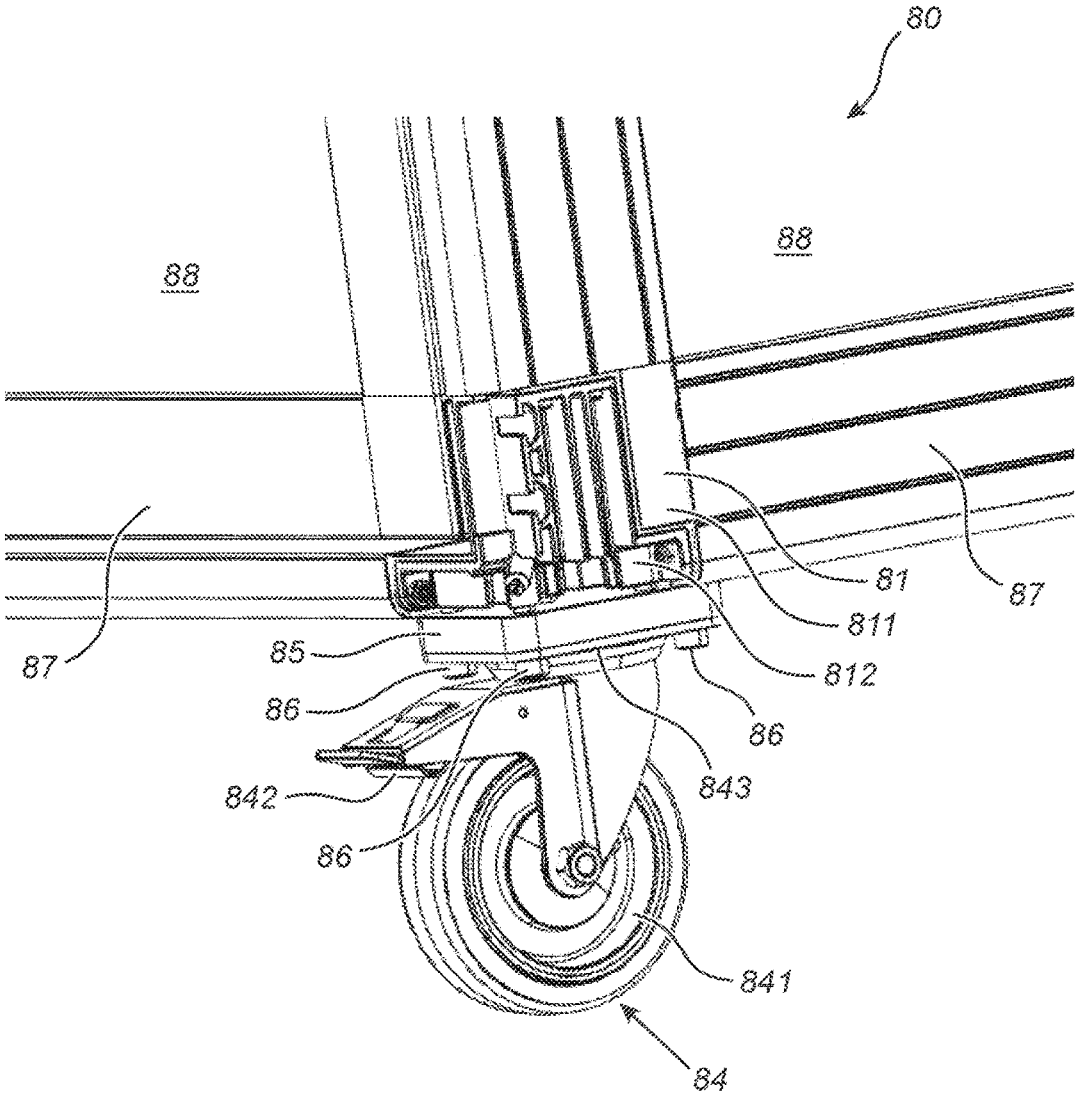
FIG. 8 shows a detailed view of an embodiment of a corner structure coupled with one wheel.

FIG. 8 shows a detailed view of an embodiment of a container 80 according to the present invention comprising a corner structure 81 coupled with one wheel 84. The corner structure comprises a first corner structure element 811 and a second corner structure element 812. The wheel 84 is coupled to the corner structure via the adapter plate 85. The wheel 84 comprises a rotating wheel element 841, a brake 842 and a connection plate 843. The connection plate 843 can be coupled to the adapter plate 85. The adapter plate 85 in combination with the connection plate 843 is coupled to the second corner structure element 812 via four screws 86. The figure further shows that the corner structure 81 is coupled to edge profiles 87. The container 80 further comprises insulation panels 88.

Figure 9A:
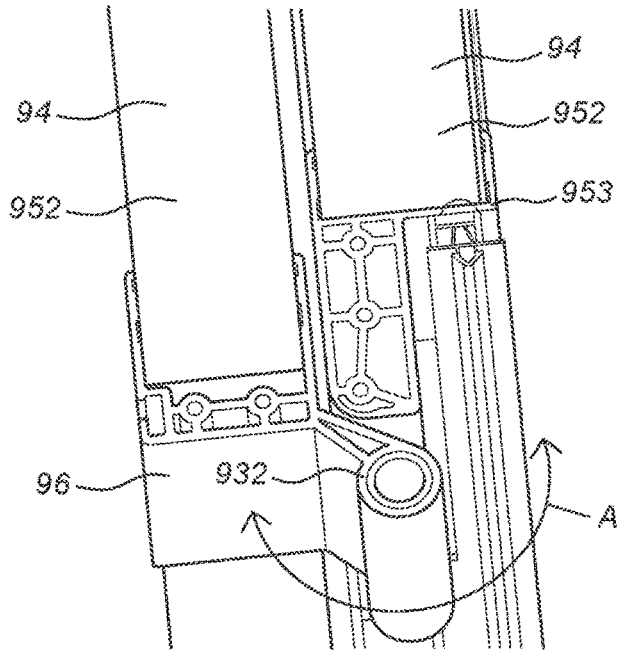
FIGS. 9*a* and 9*b* show a view of an embodiment comprising a door panel wherein the door panel can rotate 270 degrees.
Figure 9B:
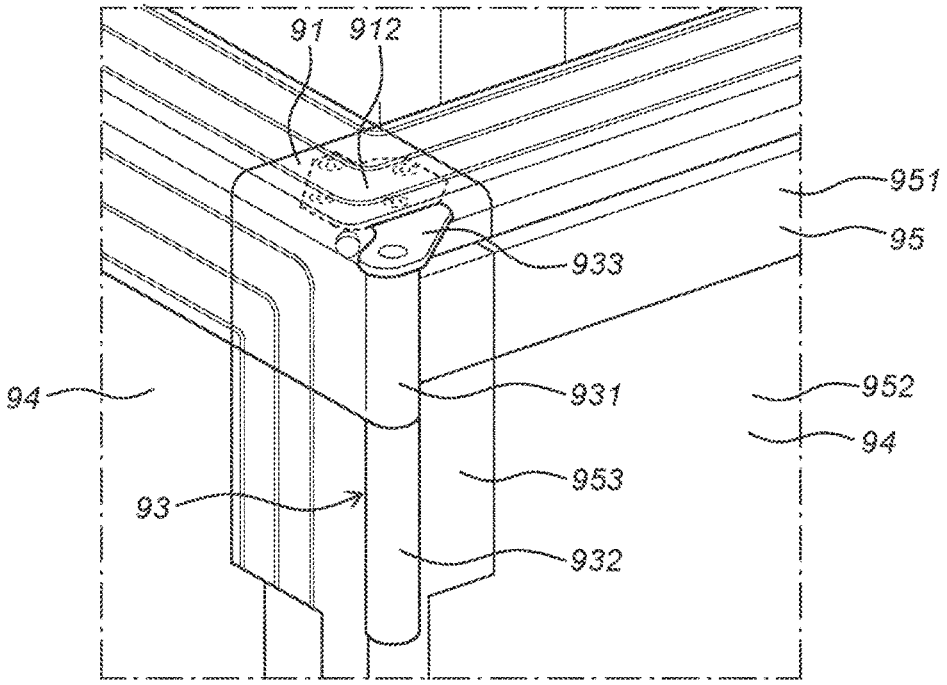

FIGS. 9*a* and 9*b* show a view of an embodiment of the container 90 according to the present invention comprising a door panel 92 wherein the door panel can rotate 270 degrees. FIG. 9 *a* is a cross-section of the embodiment shown in FIG. 9 *b* through the lower hinge part 932. The rotation of 270 degrees is shown by arrow A. The container 90 comprises a hinge 93 that comprises two parts 931 and 932. The top hinge part 931 is connected via a top connection plate 933 to the corner structure 91, in particular to the second corner structure element 912. The lower hinge part 932 is connected to a side panel 94 via an extrusion profile 96 on one side and to another thermally insulating panel 94 and extrusion profile 96 on the other side.

In the shown embodiment, the side panel 94 is formed by a door panel 95. The door panel 95 comprises a thermally insulating side panel 952 and profiles 951, 953 retaining said panel 952.

It will be clear that the invention is not limited to the exemplary embodiments which are illustrated and described here, but that countless variants are possible within the framework of the attached claims, which will be obvious to the person skilled in the art. In this case, it is conceivable for different inventive concepts and/or technical measures of the above-described variant embodiments to be completely or partly combined without departing from the inventive idea described in the attached claims.

The verb 'comprise' and its conjugations as used in this patent document are understood to mean not only 'comprise', but to also include the expressions 'contain', 'substantially contain', 'formed by' and conjugations thereof.

The invention claimed is:

1. A modular climate control container, comprising:

a plurality of insulating side panels which are configured to define a container body;

a plurality of edge profiles; and a plurality of corner structures, wherein at least one edge profile of the plurality of edge profiles defines at least part of a rib of the container body;

wherein the at least one edge profile comprises a first receiving space for receiving at least part of a first side panel of the plurality of insulating side panels, and a second receiving space for receiving at least part of a second side panel of the plurality of insulating side panels;

wherein at least one corner structure of the plurality of corner structures comprises at least two complementary corner structure elements, wherein a first corner structure element of the complementary corner structure elements is made of a first material and a second corner structure element of the complementary corner structure elements is made of a second material;

wherein the at least one, edge profile comprises complementary coupling elements for coupling between the at least one edge profile and the at least one corner structure; and wherein the first corner structure element comprises a corner structure element receiving space for receiving the second corner structure element, the corner structure element receiving space comprising at least six contact surfaces.

2. The container according to claim 1, wherein at least one corner structure element of the at least one corner structure extends in at least three directions.

3. The container according to claim 1, wherein the corner structure element receiving space comprises eight contact surfaces.

4. The container according to claim 1, wherein the first corner structure element and the second corner structure element are each provided with at least six contact surfaces for abutting contact in an assembled configuration.

5. The container according to claim 1, wherein at least one second corner structure element is configured to be coupled to at least one first corner structure element and the extrusion profiles by at least one mechanical connection element-such as a screw.

6. The container according to claim 1, wherein the first receiving space and the second receiving space of the at least one edge profile are configured such that at least part of a first side panel and at least part of a second side panel engage each other.

7. The container according to claim 1, wherein the at least one edge profile comprises a retaining member for retaining at least one side panel of the plurality of insulating side panels within a receiving space.

8. The container according to claim 1, wherein;

the at least one corner structure comprises three legs, wherein each leg is configured to be coupled with an edge profile; and/or the at least one corner structure comprises at least one support surface configured for supporting at least part of at least one side panel of the plurality of insulating side panels.

9. The container according to claim 1, wherein the at least one corner structure comprises male coupling elements, and wherein at least two edge profiles of the plurality of edge profiles comprise female coupling elements, or vice versa.

10. The container according to claim 1, wherein the at least one edge profile comprises at least one handle, and/or wherein the at least one edge profile comprises multiple mutually coupled edge profile parts.

11. The container according to claim 1, wherein the width of at least one side panel of the plurality of insulating side panels is larger than the width of the at least one edge profile.

12. The container according to claim 1, wherein at least one side panel of the plurality of insulating side panels is at least partially made of a foamed polymer.

13. The container according to claim 1, wherein at least one side panel of the plurality of insulating side panels comprises an accommodating slot for accommodating at least one cooling unit.

14. The container according to claim 1, further comprising at least one cooling unit, and/or at least one cover element configured to cover at least part of at least one corner structure, and/or at least part of at least one side panel.

15. The container according to claim 1, further comprising at least one door panel, wherein the at least one door panel is configured for making an angle of substantially 270 degrees.

16. The container according to claim 1, wherein the at least one edge profile is an extruded edge profile, and/or wherein the first corner structure element of the complementary corner structure elements is an extruded structure.

17. The container according to claim 1, wherein the second corner structure element of the complementary corner structure elements is manufactured from a metal.

18. The container according to claim 1, wherein the at least one corner structure comprises at least one reinforcement rib and/or at least one reinforcement element.

19. The container according to claim 1, wherein the first material comprises at least one polymer and wherein the second material comprises at least one metal.

20. The container according to claim 1, wherein all corner structures of the container are demountable and remountable.

* * * * *